US007163009B2

(12) United States Patent
Brown et al.

(10) Patent No.: US 7,163,009 B2
(45) Date of Patent: Jan. 16, 2007

(54) TOY GUN FOR LAUNCHING A FOAM PROJECTILE

(75) Inventors: Robert L. Brown, North Kingstown, RI (US); William Gajda, Jr., Cranston, RI (US); Steven M. Menow, Yardley, PA (US)

(73) Assignee: Hasbro, Inc., Pawtucket, RI (US)

( * ) Notice: Subject to any disclaimer, the term of this patent is extended or adjusted under 35 U.S.C. 154(b) by 414 days.

(21) Appl. No.: 10/664,536

(22) Filed: Sep. 19, 2003

(65) Prior Publication Data

US 2005/0074277 A1 Apr. 7, 2005

(51) Int. Cl.
*F41B 15/00* (2006.01)

(52) U.S. Cl. ..... 124/76

(58) Field of Classification Search ..... 124/6, 124/79, 81; 42/55, 58; 446/406
See application file for complete search history.

(56) References Cited

U.S. PATENT DOCUMENTS

| | | | | | |
|---|---|---|---|---|---|
| 1,328,929 | A * | 1/1920 | McDaniel | 124/29 |
| 2,356,706 | A * | 8/1944 | Sigg | 446/405 |
| 2,399,149 | A * | 4/1946 | Sigg | 446/405 |
| 2,566,090 | A * | 8/1951 | Marcy | 124/29 |
| 3,878,827 | A * | 4/1975 | Newgarden, Jr. | 124/81 |
| 5,097,985 | A * | 3/1992 | Jones | 221/86 |
| 5,343,849 | A | 9/1994 | Steer | |
| 5,611,321 | A | 3/1997 | Hoeting et al. | |
| 5,660,159 | A * | 8/1997 | Clayton | 124/66 |
| 5,816,232 | A | 10/1998 | Bell | |
| 5,829,635 | A * | 11/1998 | Brovelli | 222/39 |
| 5,857,451 | A | 1/1999 | Ciluffo et al. | |
| 6,276,353 | B1 | 8/2001 | Briggs et al. | |
| 6,283,871 | B1 * | 9/2001 | Briggs | 472/136 |
| 6,408,837 | B1 * | 6/2002 | Johnson et al. | 124/51.1 |
| 2002/0166551 | A1 | 11/2002 | Lee | |
| 2003/0127084 | A1 * | 7/2003 | Tippmann, Jr. | 124/49 |
| 2004/0074487 | A1 * | 4/2004 | Christopher et al. | 124/56 |
| 2006/0079150 | A1 * | 4/2006 | Filoseta et al. | 446/431 |

* cited by examiner

*Primary Examiner*—Troy Chambers
(74) *Attorney, Agent, or Firm*—Marshall, Gerstein & Borun LLP

(57) ABSTRACT

A toy gun for launching a foam projectile includes a housing having an outlet, an inlet, and a passage sized to receive the projectile. A launch station disposed in the housing and is arranged to receive the projectile, a crank rotates a resilient actuating paddle. The paddle is shiftable between an undeflected position and an energy storing deflected position, and moves along a path in response to rotation of the crank and extends into the launch station. A post is disposed in the path and is positioned to shift the paddle to the deflected position in response to rotation of the wheel, with the paddle arranged to disengage the post in response to continued rotation of the wheel thereby releasing stored energy as the paddle returns to the undeflected position and travels through the launch station.

24 Claims, 13 Drawing Sheets

TOY GUN FOR LAUNCHING A FOAM PROJECTILE

FIELD OF THE INVENTION

The present invention relates generally to a toy gun for launching foam projectiles and, more specifically, to a toy gun having a resilient actuating paddle for launching a foam projectile.

BACKGROUND OF THE INVENTION

Toy guns that launch foam projectiles are generally well known in the art. In some applications, a blast of compressed air is used to launch the projectile, while in other applications the projectile is launched using a compressed spring actuator.

Such guns tend to be quite popular with children because they satisfy the children's desire for realism. More importantly, such guns tend to be quite popular with parents because the soft projectiles satisfy the parents' desire for safety. However, a typical child has a relatively limited attention span, and thus there is a continuing need for additional toy guns that will enhance the play value of the toy and stimulate the child's imagination.

U.S. Pat. No. 5,816,232 issued to Bell discloses a rotatable feed wheel for feeding paintballs to a paintball gun. U.S. Pat. No. 5,611,321 issued to Hoeting et al. discloses a ball launching device using a rotatable launch wheel having a serrated edge that engages the ball and propels the ball out of the toy.

SUMMARY OF THE INVENTION

In one aspect, a toy gun for launching a foam projectile includes a housing having an outlet, an inlet, and a passage sized to receive the projectile. A launch station disposed in the housing and is arranged to receive the projectile, a crank rotates a resilient actuating paddle. The paddle is shiftable between an undeflected position and an energy storing deflected position, and moves along a path in response to rotation of the crank and extends into the launch station. A post is disposed in the path and is positioned to shift the paddle to the deflected position in response to rotation of the wheel, with the paddle arranged to disengage the post in response to continued rotation of the wheel thereby releasing stored energy as the paddle returns to the undeflected position and travels through the launch station.

In accordance with a disclosed example, the toy gun may include a feed tube sized to hold a plurality of the projectiles, with the feed tube removably attached to the housing and arranged to communicate projectiles to the inlet. The toy gun may also include a plurality of resilient actuating paddles, and may include a stop disposed adjacent the inlet and shiftable between a first position in which the stop prevents a projectile from entering the launch station and a second position in which the stop permits a projectile to enter the launch station. The stop preferably shifts between the first position and the second position in response to rotation of the axle.

The toy gun may also include a first stop and a second stop, and a feed station disposed adjacent the inlet, with the first stop and the second stop cooperating to permit only a single ball at a time to enter the feed station and the launch station, the first and second stops responsive to movement of the paddle. The housing preferably includes a constriction between the launch station and the outlet, the constriction sized to maintain the projectile in the launch station, the constriction further sized to permit passage of the projectile from the launch station to the outlet in response to the application of a force to the projectile.

Preferably, the crank is operatively coupled to the paddle wheel by a gear train, and a pivot lever is disposed adjacent the inlet and is arranged to shift in response to mounting a feed tube to the housing adjacent to the inlet. A cam plate is disposed in the gear train and is shiftable between a first state in which the crank and the paddle wheel are operatively decoupled and a second state in which the crank and the paddle wheel are operatively coupled, with the cam plate being responsive to movement of the pivot lever. A link arm may connect the pivot lever and the cam plate.

The toy gun preferably includes a feed control mechanism disposed adjacent the inlet. The feed control mechanism includes a first stop and a second stop, and the first and second stops are arranged to respond to movement of the paddle wheel. The first stop is disposed adjacent the feed station and is arranged to shift between a first position in which a ball is retained at the feed station and a second position in which a ball may pass from the feed station toward the launch station. The second stop is disposed adjacent the feed station and is arranged to shift between a first position in which a ball is prevented from entering the feed station and a second position in which a ball may pass into the feed station. Preferably, the first stop and the second stop are responsive to movement of the paddle wheel, with the first stop and the second stop preferably being operatively coupled to each other.

In another aspect, a toy gun for launching a foam ball, the toy gun includes a housing having an outlet and an inlet sized to permit passage of the ball, a launch station disposed in the housing and arranged to receive the projectile from the inlet, a crank mounted to the housing, and a paddle wheel disposed within the housing and having a plurality of resilient actuating paddles, with the paddle wheel mounted to a rotatable axle that is operatively coupled to the crank. Each paddle is shiftable between an undeflected position and an energy storing deflected position, with each paddle moveable along a path in response to rotation of the axle and sized to extend into the launch station. A post disposed in the path and do is positioned to shift each paddle in succession to the deflected position in response to rotation of the axle, with each paddle further arranged to disengage the post in response to continued rotation of the axle thereby releasing stored energy as the paddle returns to the undeflected position and travels through the launch station.

In yet another aspect, a toy gun for launching a foam ball includes a housing having an outlet and an inlet, both the outlet and the inlet sized to permit passage of the ball, a launch station disposed in the housing, with the launch station arranged to receive the projectile from the inlet, a crank mounted to the housing, and a paddle wheel disposed within the housing and having a plurality of resilient actuating paddles, the paddle wheel mounted to a rotatable axle. A gear train operatively couples the crank to the axle, with the gear train including a clutch shiftable between a first position in which the axle is responsive to movement of the crank and a second position in which the axle is not responsive to movement of the crank. Each paddle is shiftable between an undeflected position and an energy storing deflected position, with each paddle being moveable along a path in response to rotation of the axle and sized to extend into the launch station. A catch is disposed in the path and is positioned for abutting contact with a selected one of the paddles as the axle is rotated, the catch arranged to shift the selected paddle to the deflected position in response to further rotation of the axle, the catch further arranged to release the selected paddle in response to still further rotation of the axle, such that the paddle is released from the catch and releases the stored energy as the selected paddle returns to the undeflected position and travels through the launch station.

In a still further aspect, a toy gun for launching a foam projectile comprises a housing having an outlet, an inlet, and a passage extending between the outlet and the inlet sized to permit passage of the projectile, a launch station disposed in the housing and arranged to receive the projectile from the inlet, a rotatable wheel disposed within the housing and having at least one resilient actuating paddle, with the paddle shiftable between an undeflected position and an energy storing deflected position, the paddle being moveable along a path in response to rotation of the wheel and sized to extend into the launch station. A post is disposed in the path and is positioned to shift the paddle to the deflected position in response to rotation of the wheel. The paddle is arranged to disengage the post in response to continued rotation of the wheel thereby releasing stored energy as the paddle returns to the undeflected position and travels through the launch station.

DETAILED DESCRIPTION OF VARIOUS EMBODIMENTS

Figure 1:
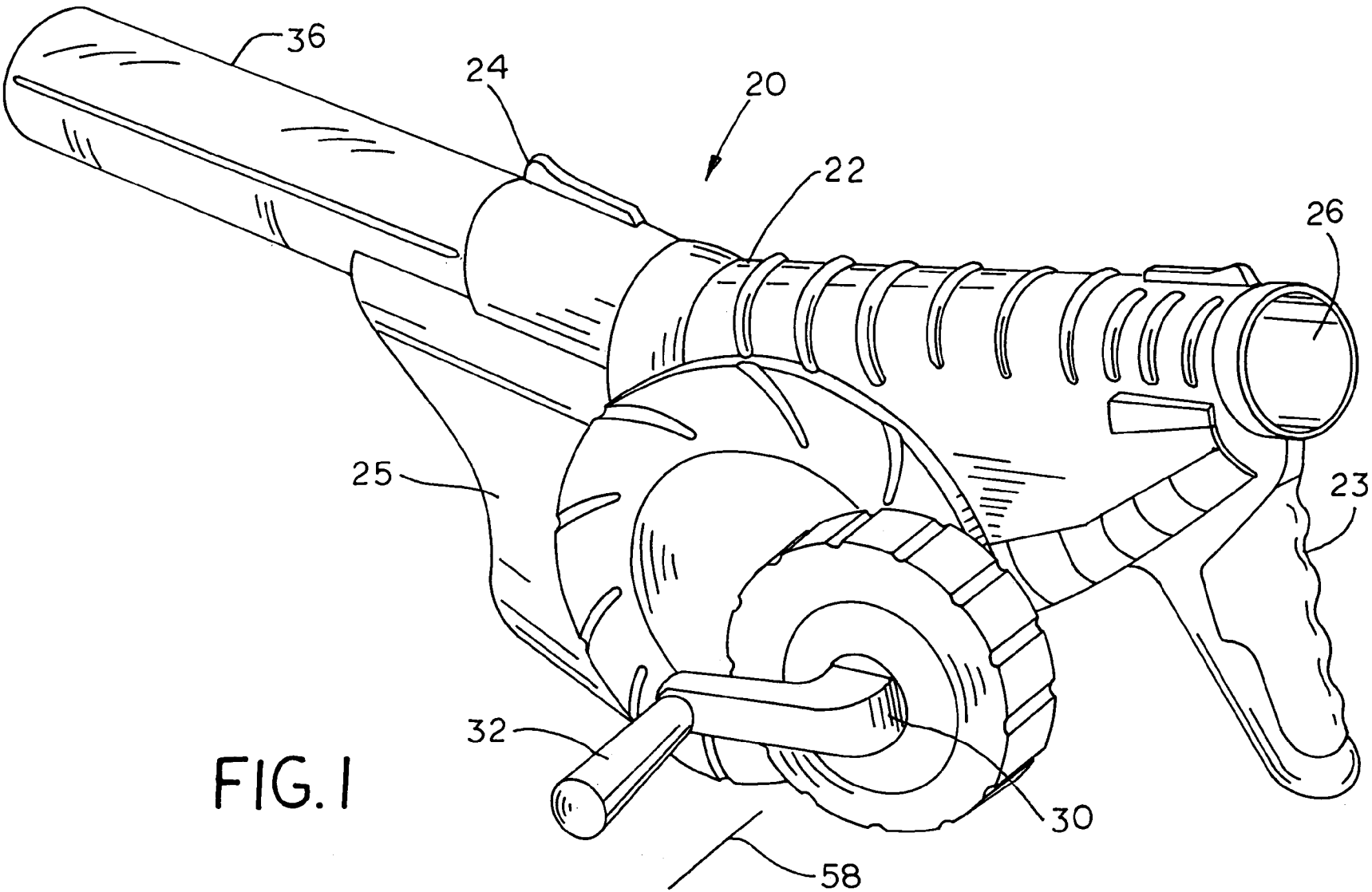
FIG. 1 is a perspective view of a toy gun assembled in accordance with the teachings of the present invention.

Referring now to FIGS. 1–6 of the drawings, a toy gun assembled in accordance with the teachings of the present invention is generally referred to by the reference numeral 20. The toy gun 20 includes a housing 22 having an inlet 24 and an outlet 26. The housing 22 may be formed in two halves using conventional techniques and materials, such as, for example, high impact plastic of the type commonly used in the art. The inlet 24 and the outlet 26 are both sized to permit passage of a projectile 28 (the projectile 28 is shown in FIGS. 2–6). A crank 30 is mounted to the housing 22 and includes a handle 32 (visible in FIGS. 1, 10 and 11), and the crank 30 may be rotated by a user (not shown) in order to impart rotation to a paddlewheel 34 disposed in the housing 22 and visible in FIGS. 2–6. A feed tube 36 is removably mountable to the housing 22 of the toy gun 20 adjacent to the inlet 24, thus permitting, in the disclosed example, projectiles 28 to be delivered to the inlet 24 in succession as will be explained in greater detail below. Preferably, the feed tube will include a spring 39 (FIGS. 4, 5 and 6) arranged to urge the projectiles 28 toward the inlet 24 of the housing 22. Still preferably, the feed tube 36 may be retained in the inlet 24 by a friction fit, and may include suitable guides or grooves as would be known. The feed tube 36 may also include a protrusion 41. It will be appreciated that the housing 22 may take a variety of forms, and may include at least one suitable hand grip 23 and/or a shoulder stop 25 to facilitate grasping of the toy gun 20 by a user (not shown).

Referring now to FIGS. 2–6, a generally tubular passage 38 is defined inside the housing 22 and extends generally between the inlet 24 and the outlet 26. A launch station 40 is defined within the housing 22 along the passage 38. A feed station 42 is also defined within the housing 22 along the passage 38, and it will be appreciated that the projectile 28 to be launched by the toy gun 20, in the disclosed example, will first enter the feed station 42 and then will enter the launch station 40. Also, it will be understood that one or more of the projectiles 28 will be communicated to the inlet 24 of the housing 22 by the feed tube 36.

In accordance with the disclosed example, the projectiles 28 are round balls. Alternatively, the projectiles 28 may take a variety of other suitable forms.

The launch station 40 preferably includes a slight constriction 44, which in the disclosed example, is sized such that the projectile 28 will be retained at the launch station 40 until the projectile 28 is launched by the paddlewheel 34 as will be explained below. Preferably, the constriction 44 will cooperate with the projectile 28 such that there is a friction fit between the constriction 44 and the projectile 28. It will be appreciated that, when the projectile 28 is launched as will be explained in greater detail below, the projectile 28 and/or the constriction 44 may deform slightly so as to permit the projectile 28 to pass the constriction 44.

The paddlewheel 34 includes a central axle 46 which rotates about an axis 48 (the axis 48 extends into the plane of the Figures when viewing FIGS. 2–6). The paddlewheel 34 preferably includes a number of radially outwardly extending paddles 50. Each paddle 50 includes a base 52 and an outer end 54, with the outer ends 54 traveling along a generally circular path 56 in response to rotation of the paddlewheel 34 and the axle 46 about the axis 48. In the disclosed example, it will be appreciated that the crank 30 is rotatable about an axis 58 which, in the disclosed example, is offset from the axis 48 of the paddlewheel 34.

The toy gun 20 includes a gear train 60 (concealed by a cover in FIGS. 2–6 but visible in FIGS. 7 and 8) for imparting rotation of the crank 30 to the paddlewheel 34 as will be explained in greater detail below. The toy gun 20 preferably also includes a clutch or coupling mechanism 62. The coupling mechanism 62 enables the crank 30 and the paddlewheel 34 to be selectively coupled or decoupled. In the coupled state it will be appreciated that rotation of the crank 30 about the axis 58 will result in corresponding rotation all of the paddlewheel 34 about the axis 48 (see FIG. 8). In the decoupled state, rotation of the crank 30 about the axis 58 will not result in rotation of the paddlewheel about its axis 48 (see FIG. 7).

Figure 2:
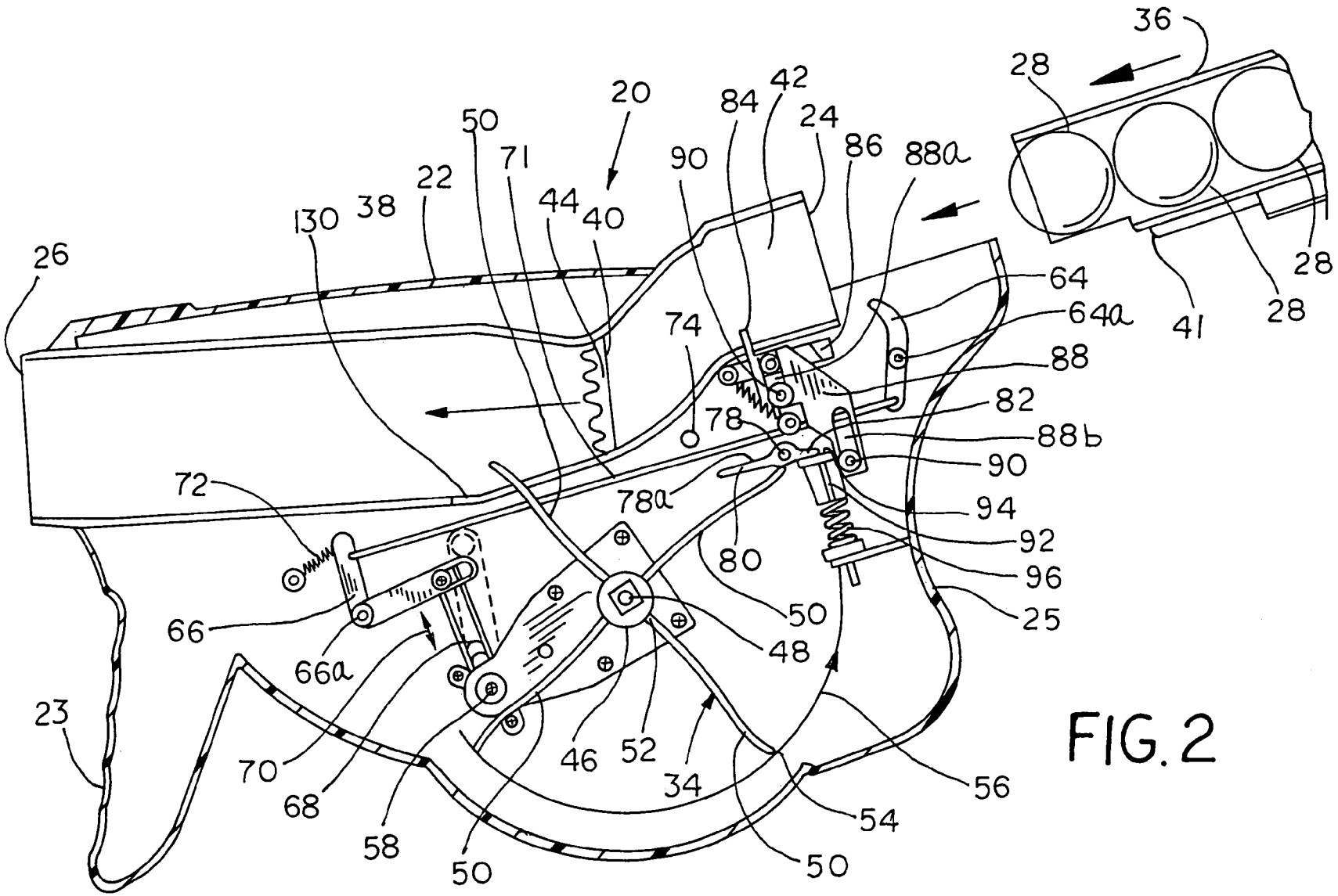
FIG. 2 is an enlarged fragmentary cross-sectional view of the toy gun of FIG. 1 and illustrating the feed tube detached from the main body of the toy.

The coupling mechanism 62 includes a pivot lever 64 mounted in the housing 22 and disposed generally adjacent to the inlet 24, such that the pivot lever is pivoted about an axis 64*a* from the position illustrated in FIG. 2 toward the position illustrated in FIGS. 3–6 in response to securing the feed tube 36 to the housing 22. The pivot lever 64 preferably is shifted by contact with the protrusion 41 on the feed tube 36 as the feed tube 36 is mounted to the housing 22.

The coupling mechanism 62 also includes a pivot lever 66 and a sliding cam plate 68. The pivot lever 64 is connected to the pivot lever 66 by a link 71, such that pivoting of the pivot lever 64 about its axis 64*a* results in pivoting of the pivot lever 66 about an axis 66*a*. The cam plate 68 is preferably guided for movement along a generally linear path 70 (also visible in FIGS. 9–11) which, in the disclosed example, is arranged to intersect the axis 58 of the crank 30. A spring 72 is connected to the pivot lever 66, so as to urge the coupling mechanism 62 toward the decoupled state illustrated in FIGS. 2 and 7.

A post 74 or other suitable catch is mounted in the housing 22 and extends generally parallel to the axis 48 of the paddlewheel 34. It will be appreciated that the post 74 is positioned within the housing 22 so as to generally lie within the generally circumferential path 56 of the paddles 50. The paddles 50 are preferably constructed of nylon or any other suitable material, such that each paddle may bend or deflect from an undeflected position of FIGS. 2 and 3 to a bent or deflected position of FIG. 4.

Figure 4:
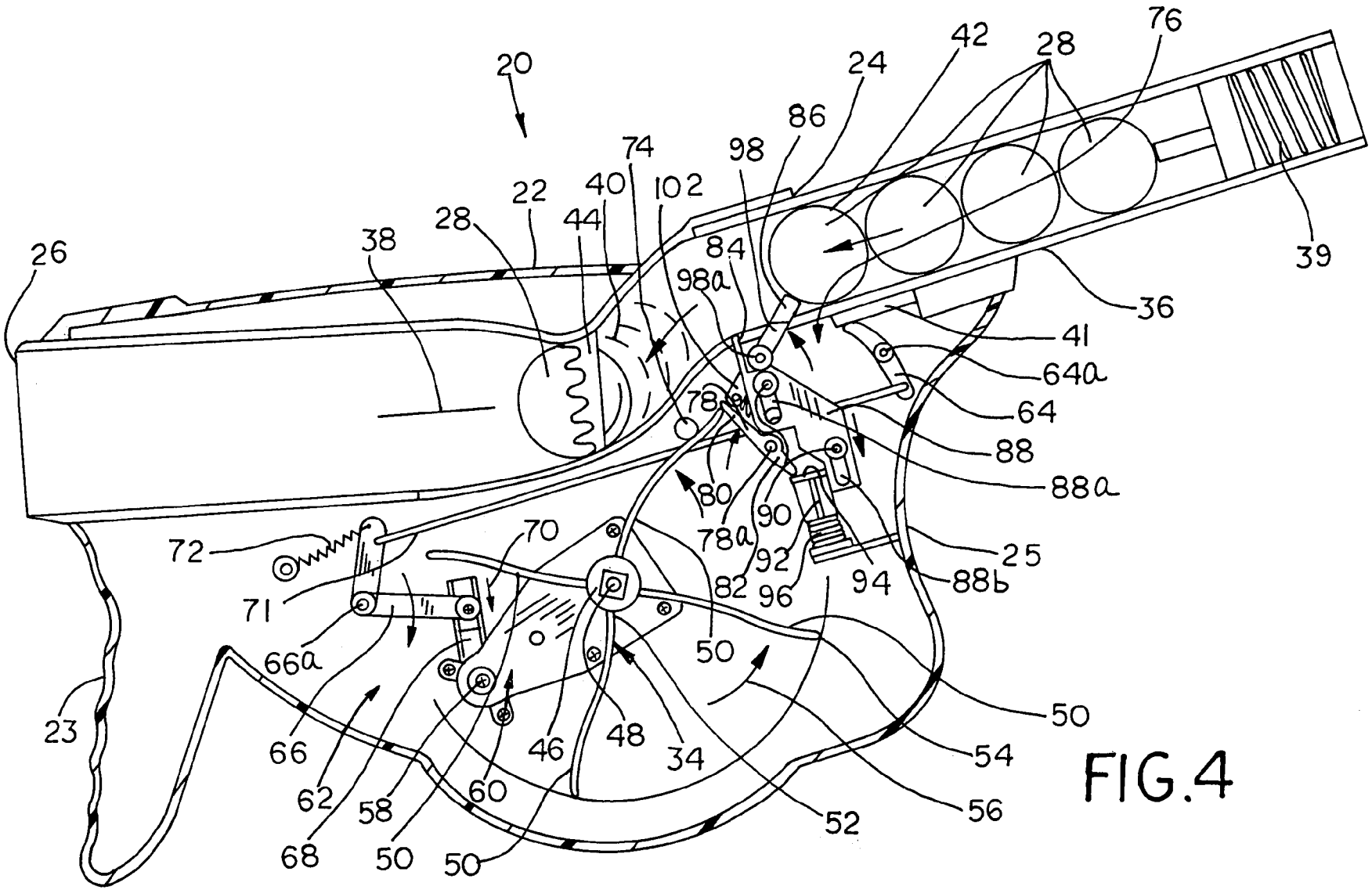
FIG. 4 is an enlarged fragmentary cross-sectional view similar to FIGS. 2 and 3 and illustrating a ball disposed in the launch station.

As the paddlewheel 34 is rotated, each paddle 50 will come into contact with the post 74 as can be seen in FIG. 4. Continued rotation of the crank 30 and the axle 46 of the paddlewheel 34 causes the paddle to deflect or bend backward relative to the axle 46 because the end 54 of the paddle 50 is caught on the post 74. This deflection causes the paddle 50 to store energy. Eventually, continued rotation of the paddlewheel 34 causes the paddle to slide off of or disengage the post 74, and the paddle then releases the stored energy as it returns to its original undeflected position. The post 74 is positioned so that the end 54 of the paddle 50 travels through the launch station 40 as the energy is released, thus transferring energy to the projectile 28 as shown in FIG. 5, which launches the projectile 28 through the outlet 26 in rapid fashion.

The toy gun 20 also preferably includes a feed mechanism 76. The feed mechanism 76 includes a pivot lever 78 shiftable about an axis 78*a* and having a first arm 80 and a second arm 82. It will be appreciated that the first arm 80 is sized to extend into the path 56 of the paddles 50, and further is positioned such that the arm 80 is encountered by the end 54 of each paddle 50 prior to each paddle 50 encountering the post 74.

The feed mechanism 76 includes a first stop 84 and a second stop 86. The first and second stops 84, 86 are disposed generally adjacent to the inlet 24, and are spaced apart along the entry of the passage 38 so as to generally straddle the feed station 42. In the disclosed example, the first stop 84 includes a plate 88 having a pair of slots 88*a* and 88*b*. The plate 88 is mounted within the housing 22 by a pair of screws 90 which intersect the slots 88*a* and 88*b*, such that the plate 88 reciprocates, guided by the slots 88*a* and 88*b*, between a first position in which the stop 84 is disposed in the passage 38 as shown in FIGS. 2, 3 and 5, and a second position in which the stop 84 is lowered out of the passage 38 as shown in FIGS. 4 and 6.

Figure 3:
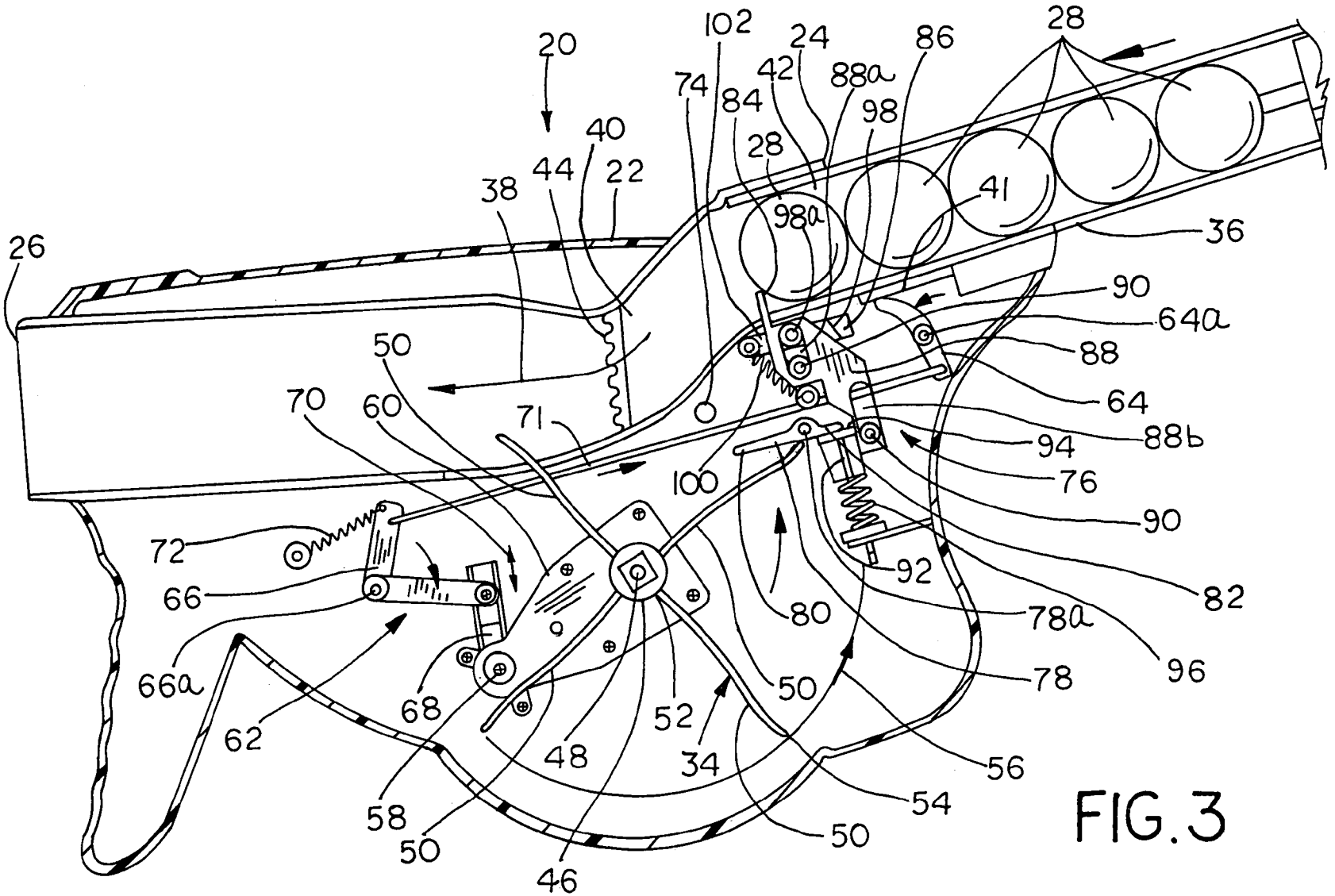
FIG. 3 is an enlarged fragmentary cross-sectional view similar to FIG. 2 and illustrating the feed tube attached to the main body.
Figure 5:
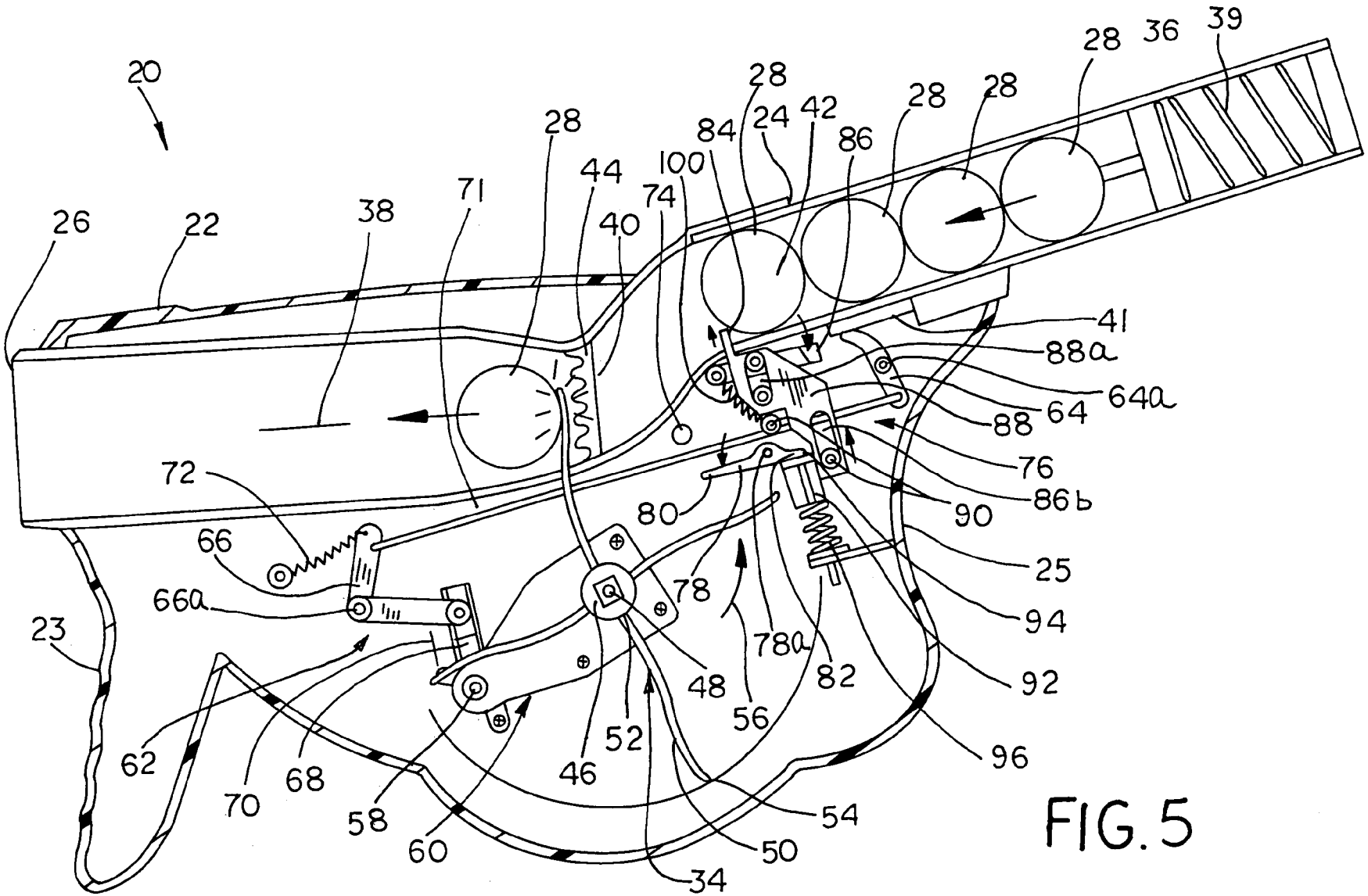
FIG. 5 is an enlarged fragmentary cross-sectional view similar to FIGS. 2–4 and illustrating a ball being launched from the launch station by the paddle wheel.
Figure 6:
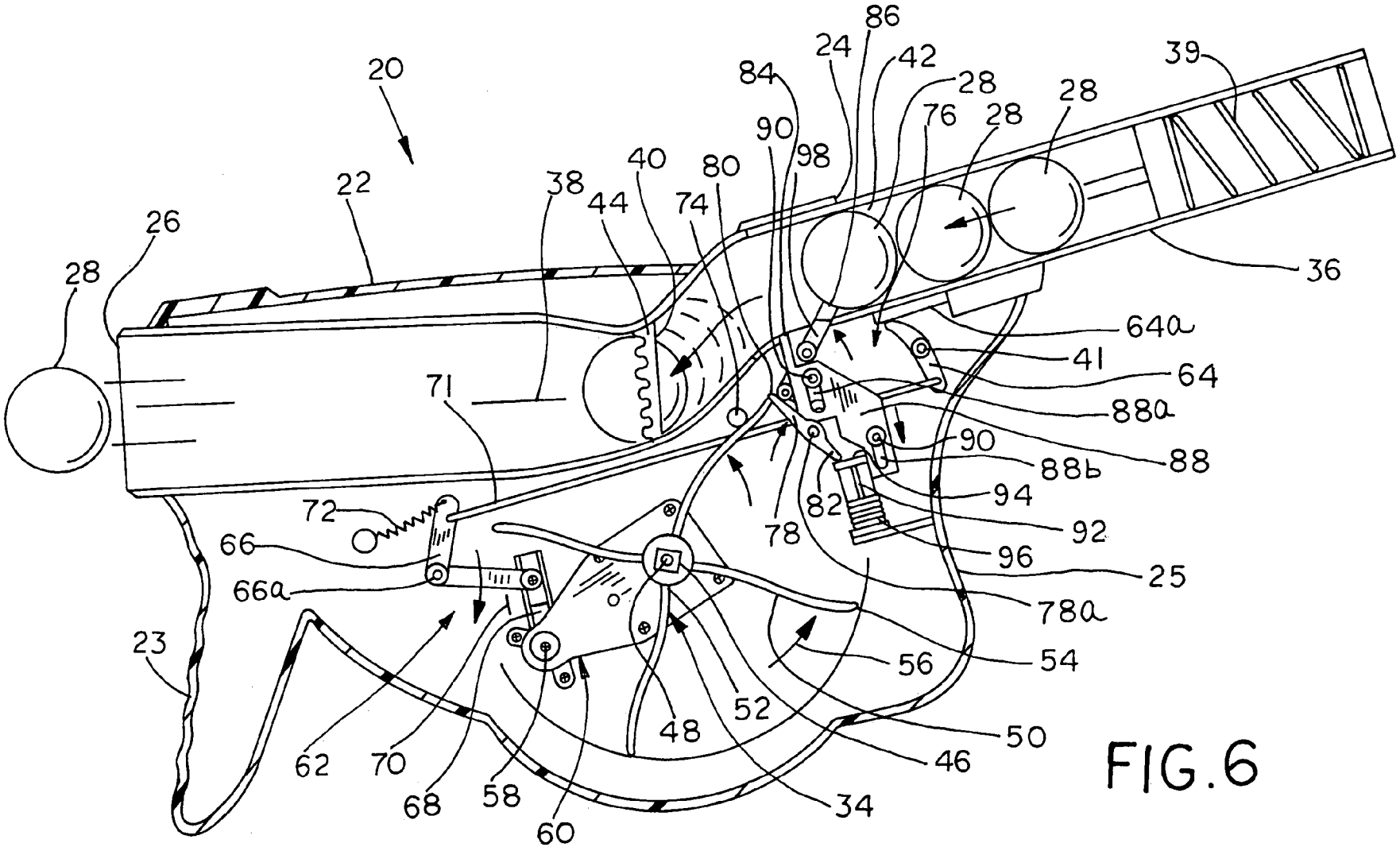
FIG. 6 is an enlarged fragmentary cross-sectional view illustrating the next ball entering the launch station from the feed tube.

A lower end 92 of the plate 88 includes a platform 94, and a spring 96 is mounted within the housing 22 and engages the lower end 92 of the plate 88 so as to bias the plate 88 generally upward when viewing the Figures, thus biasing the stop 84 towards the first position as shown in FIGS. 2, 3 and 5. It will be appreciated that the second arm 82 of the pivot lever 78 is positioned to make contact with a platform 94 of the plate 88, such that when the end 54 of one of the paddles 50 comes into contact with the first arm 80 of the pivot lever 78, the pivot lever 78 will pivot about its axis 78*a* causing the second arm 82 to bear against the platform 94, thus driving the plate 88 down.

Figure 12:
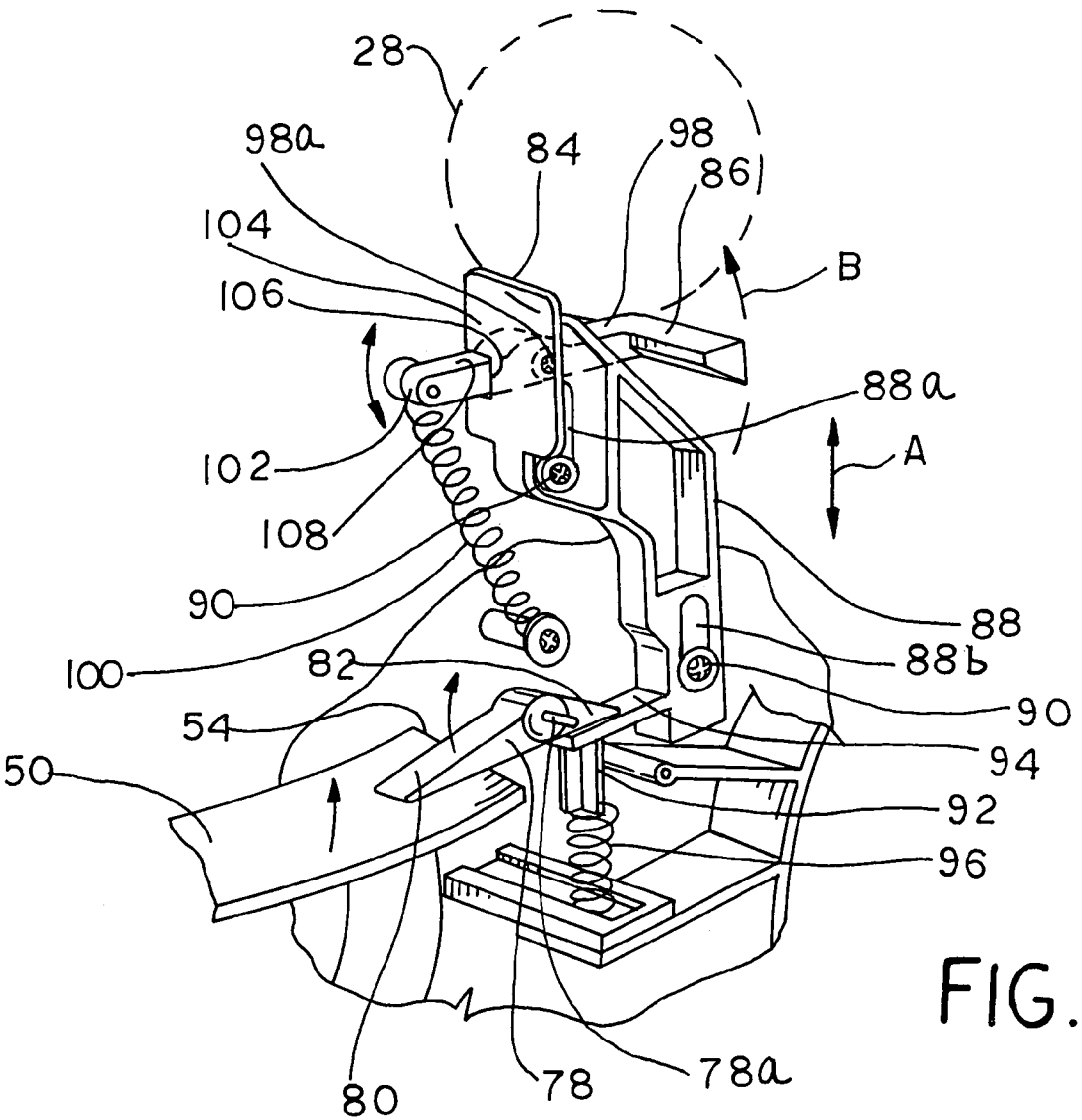
FIG. 12 is an enlarged fragmentary view in perspective of the feed control mechanism.

The second stop 86 includes a pivot lever 98 pivotable about an axis 98*a*, both of which are best viewable in FIG. 12. A spring 100 (visible in FIGS. 2, 3, 5 and 12) engages an end 102 of the pivot lever 98, with the end 102 disposed on the opposite side of the axis 98*a* relative to the second stop 86. It will be appreciated that the second stop 86 is pivotable about the axis 98*a* between a first position in which the stop 86 is disposed in the passage 38 generally adjacent the inlet 24 and in front of the feed station 42 as shown in FIGS. 4 and 6, and a second position in which the second stop 86 is lowered out of the passage 38 as shown in FIGS. 2, 3 and 5.

Referring now to FIG. 12, it will be appreciated that the first stop 84 and the second stop 86 are preferably operatively coupled to each other. More specifically, an upper portion 104 of the plate 88 of the first stop 84 preferably includes a slot 106. The second stop 86 includes an arm 108 disposed between the axis 98*a* and the end 102. The slot 106 is sized to receive the arm 108, such that when the plate 88 reciprocates vertically guided by the slots 90 along a path A, the upper part 104 of the plate 88 causes the second stop 86 to pivot about the axis 98*a*, such that the second stop 86 travels along a generally arcuate path B. The spring 100 engaging the end 102 biases the second stop 86 generally upwardly along the path B. Thus, by virtue of the operative interconnection between the first stop 84 and the second stop 86, it will be appreciated that when the first stop 84 is in the first position as shown in FIG. 12, the second stop 86 will be in the second position. However, when pivoting movement of the pivot lever 78 about its axis 78*a* causes the plate 88 to travel downwardly along the path A, the first stop 84 will be lowered to its second position disposed out of the passage 38, and the second stop 86 will be raised along its arcuate path B to its first position disposed in the passage 38.

Figure 7:
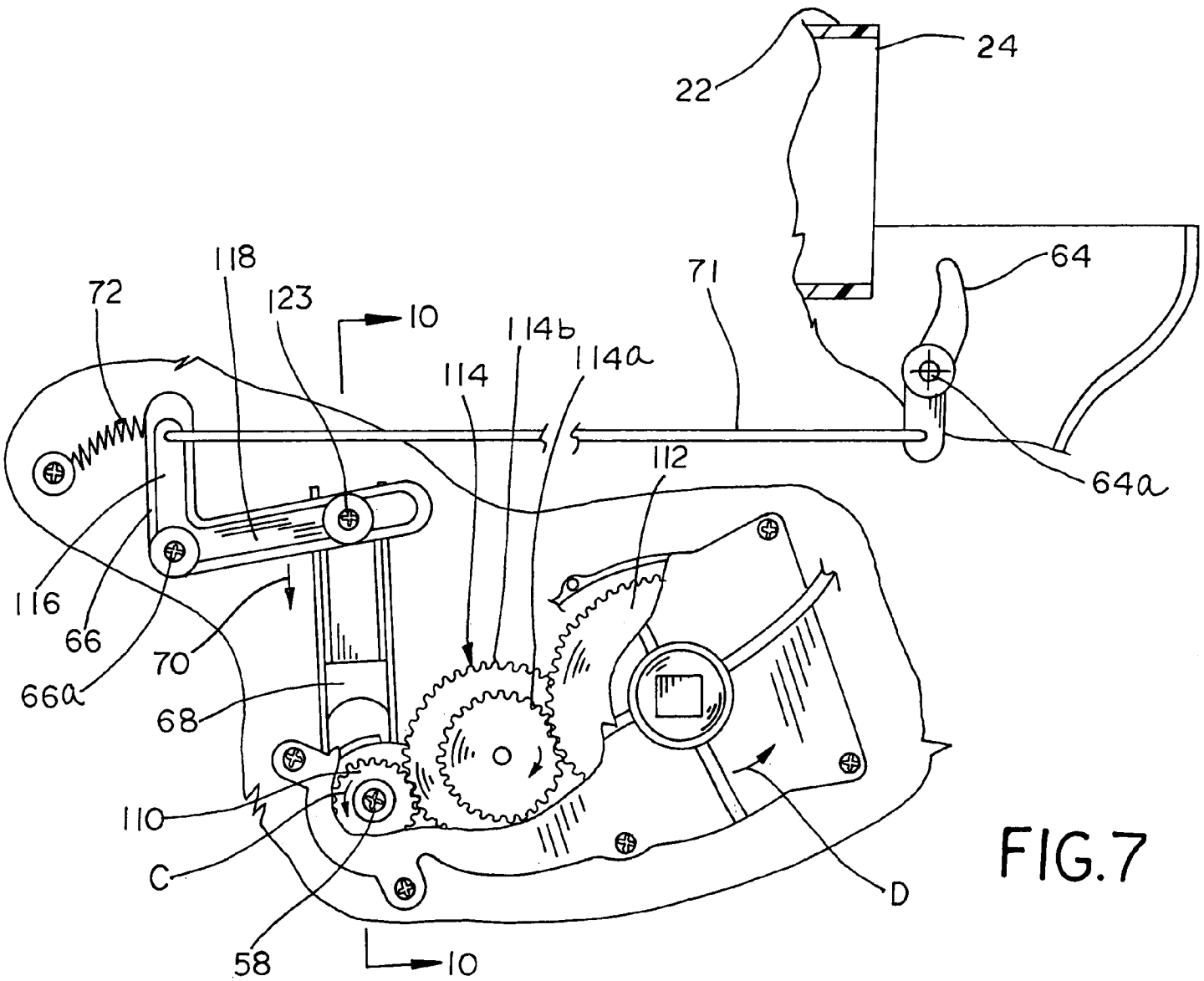
FIG. 7 is a further enlarged fragmentary view of the mechanism for operatively coupling the crank to the paddle wheel and illustrating the system in a decoupled state.
Figure 8:
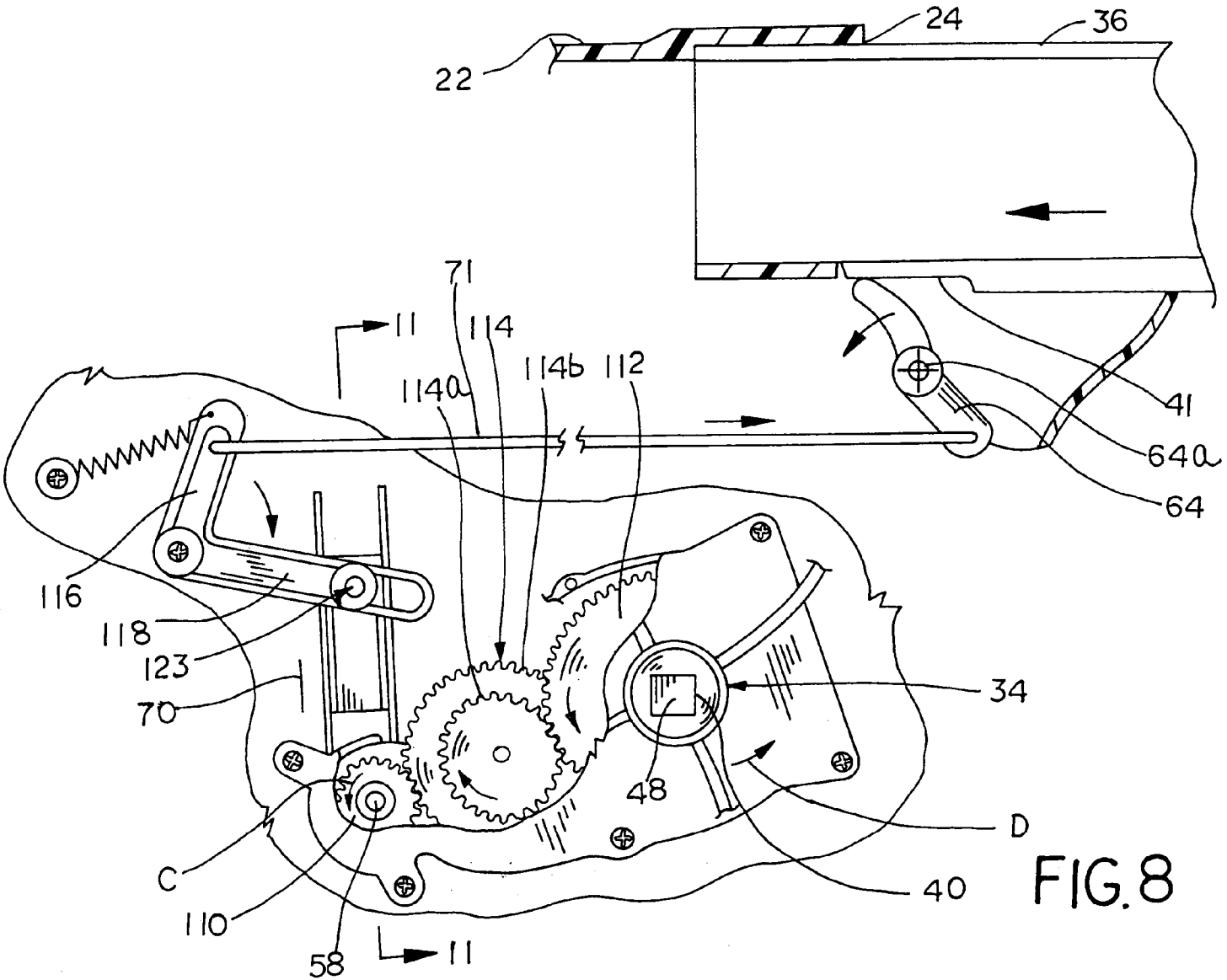
FIG. 8 is an enlarged fragmentary view similar to FIG. 7 and illustrating the system in a coupled state caused by mounting the feed tube to the main body of the toy gun.

Referring now to FIGS. 7 and 8, the gear train 60 is connected to the coupling mechanism 62 as shown. The gear train 60 includes a gear 110 which is rotatable about the axis 58 of the crank 30. The gear train 60 also includes a gear 112 which is rotatable about the axis 48 of the axle 46 and the paddlewheel 34, and an intermediate idler gear 114 having an inner cog 114*a* and an end outer cog 114*b*. Thus, when the coupling mechanism 62 is in the coupled state as will be discussed in greater detail below, rotation of the crank 30 and the gear 110 in the direction C is transferred via the intermediate idler gear 114 to the gear 112 in the direction D, thus causing the paddlewheel 34 to rotate in the direction D.

In the decoupled state illustrated in FIG. 7, the pivot lever 66 is biased in a generally counterclockwise direction due to the spring 72 which is connected to an arm 116 of the lever arm 66. Another arm 118 of the pivot lever 66 is connected to the cam plate 68. When the pivot lever 66 is biased in the counter clockwise direction about the axis 66*a* as shown, the cam plate 68 is positioned upwardly away from the gear 110 when viewing FIG. 7. As shown in FIG. 8, when the feed tube 36 is connected to the inlet 24 of the housing 22, a portion of the feed tube 36 contacts the pivot lever 64 and causes the pivot lever 64 to pivot about the axis 64*a*, thus pulling the link arm 70 toward the right when viewing FIG. 8. The displacement of the link arm 71 causes the pivot lever 66 to pivot in a generally clockwise direction about the axis 66*a*, thereby driving the arm 118 generally downwardly, which in turn drives the Cam plate 58 generally downwardly along the path toward the axis 58 of the gear 110 and the crank 30.

Figure 9:
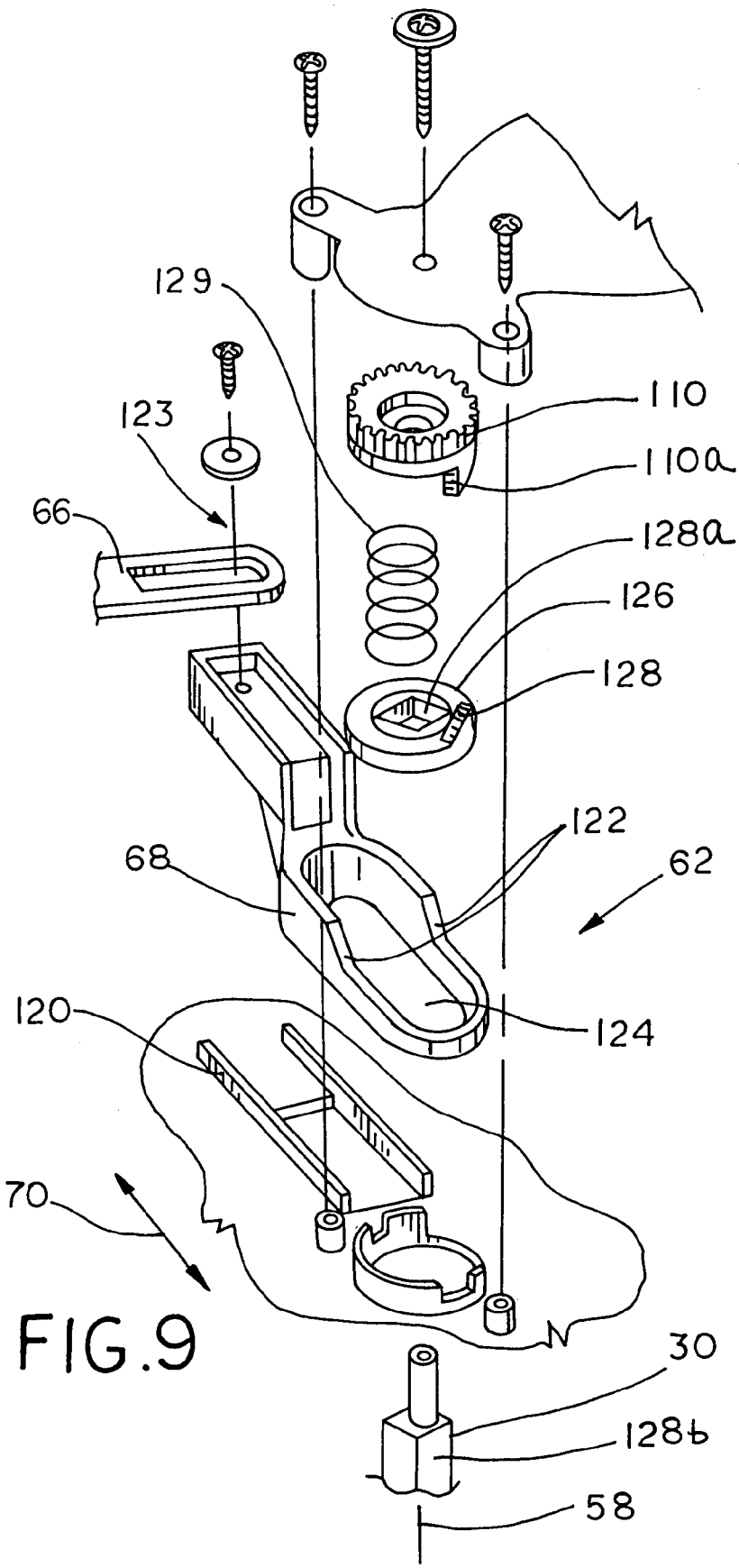
FIG. 9 is an enlarged exploded view in perspective of the coupling mechanism.
Figure 10:
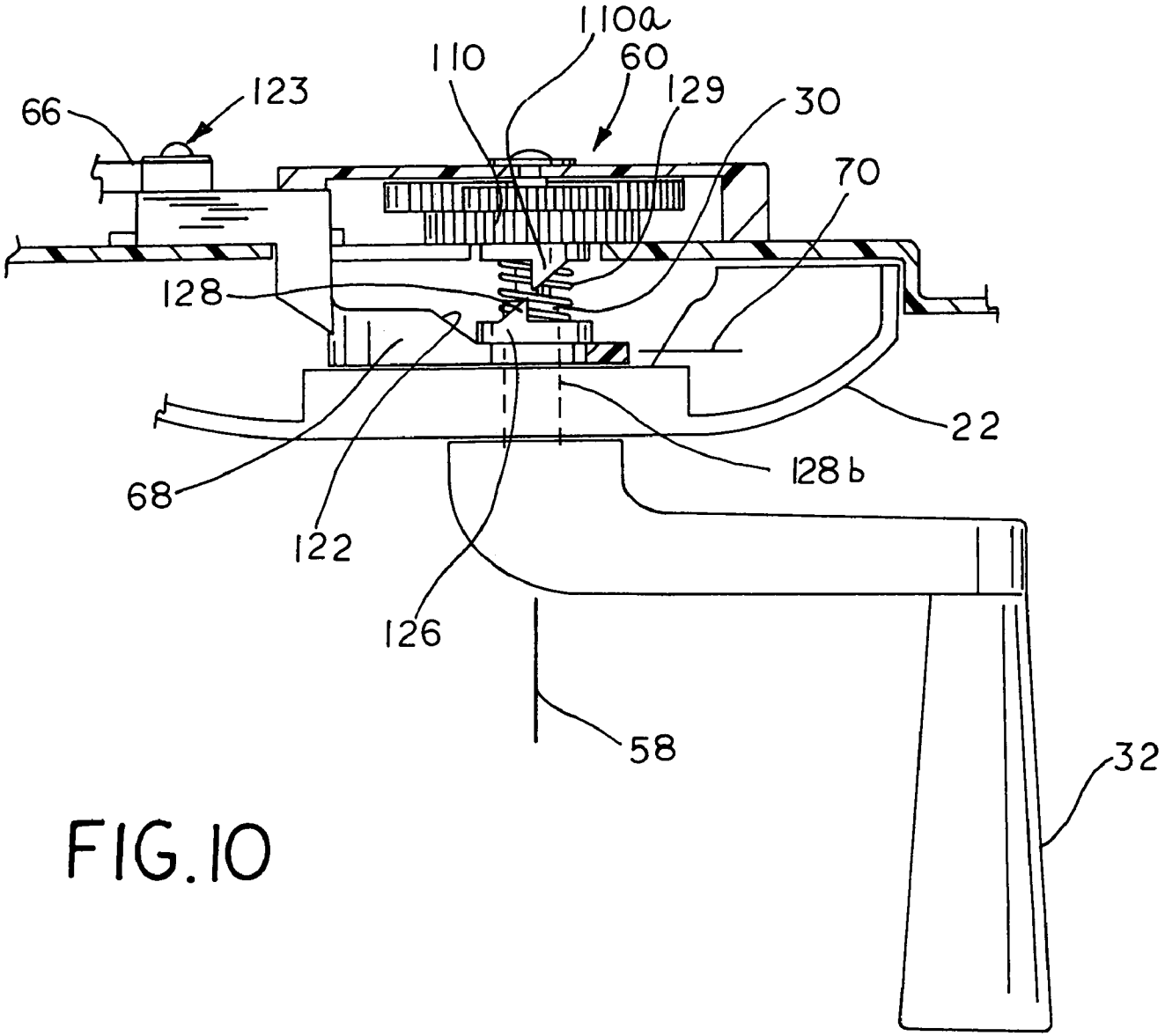
FIG. 10 is an enlarged fragmentary cross-sectional view of a portion of the coupling mechanism taken along the line 10—10 of FIG. 7 and illustrating the coupling mechanism in a decoupled state.

Referring now to FIG. 9, further components of the coupling mechanism 62 are shown. The cam plate 68 is mounted to a guide 124 guiding the cam plate 68 along the generally linear path 70. The cam plate 68 includes a pair of angled camming surfaces 122 separated by a slot 124. The slot 124 is sized to receive the square portion 128*b* of the crank 30, such that the angled camming surfaces 122 generally straddle the axis 58 of the crank 30. The toothed washer 126 includes a single angled tooth 128 and a central square aperture 128*a*, and is separated from the gear 110 by a spring 129 which biases the toothed washer 126 away from the gear 110 as can be seen in FIG. 10. The central square aperture 128*a* is sized to engage the square portion 128*b* on the crank 30, such that the toothed washer 126 will rotate with rotation of the crank 30 about the axis 58, and further so that the toothed washer 126 will slide along the square portion 128*b* of the crank 30 in a generally vertical direction when viewing FIG. 9. It will be understood that, when the toy gun 20 is positioned as shown the in FIGS. 2–8, the axis 58 and hence the direction of travel or sliding movement of the toothed washer 126 is in a direction extending into the plane of the Figures. It will also be understood that the toothed washer 126 will slide along the squared portion 128*b* of the crank 30 by virtue of the angled camming surfaces 122 bearing against the toothed washer 126 as operation of the coupling mechanism 62 shifts the cam plate 68 along the path 70. The cam plate 68 is pivotally attached to the pivot lever 66 by a slotted pivot connection 123.

Figure 11:
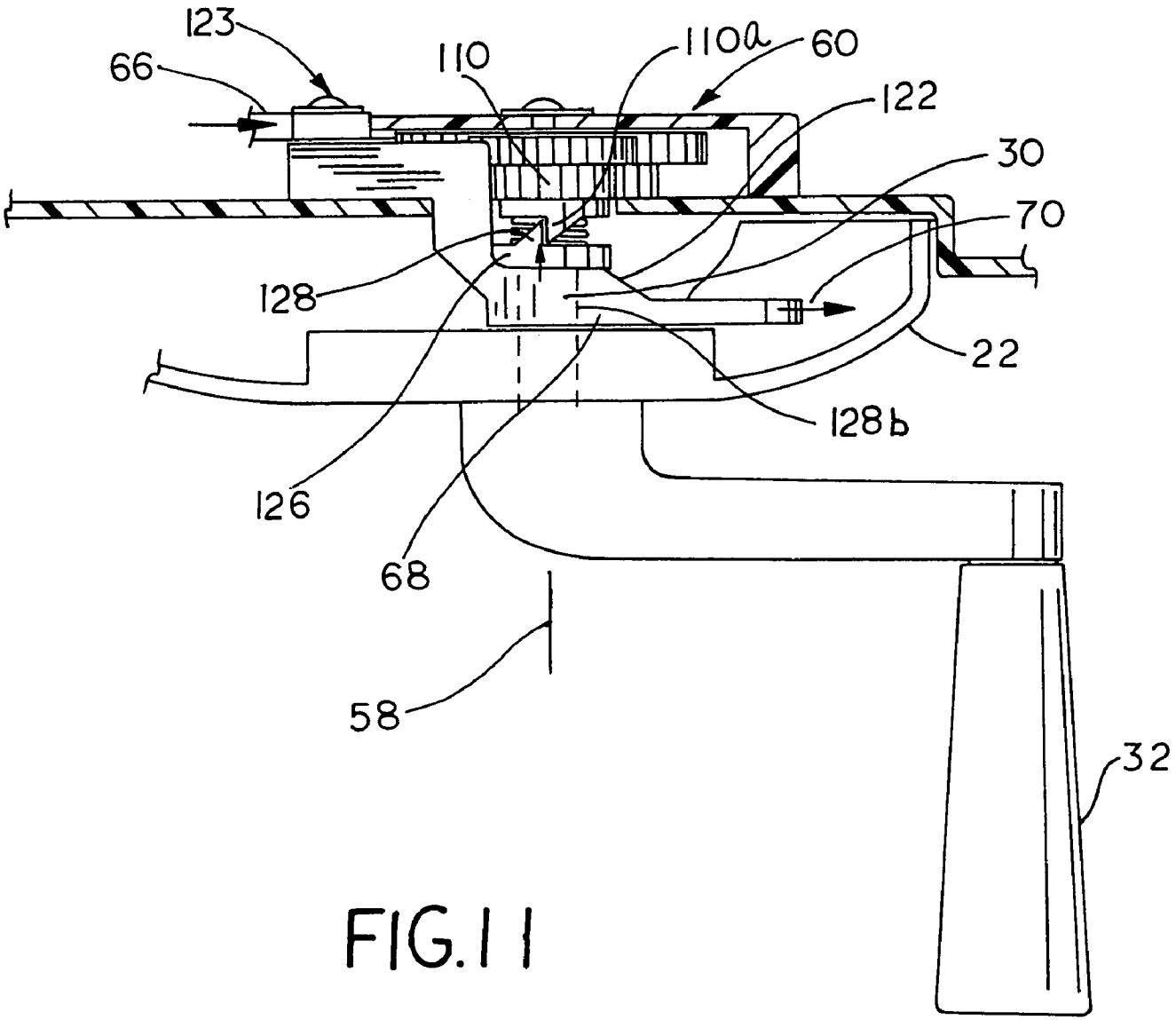
FIG. 11 is an enlarged fragmentary cross-sectional view taken along line 11—11 of FIG. 8 and illustrating the coupling mechanism in a coupled state.

Referring now to FIG. 10, the coupling mechanism 62 is shown in a decoupled state with the spring 129 maintaining the toothed washer 126 away from the gear 110. In response to movement of the cam plate 68 from the position shown in FIG. 10 toward the position shown in FIG. 11, the angled camming surfaces 122 bear against the toothed washer 126, thus urging the tooth 128 into a position to contact a tooth 110*a* on the gear 110. When the cam plate 68 is positioned as shown in FIG. 11, the coupling mechanism 62 is in a coupled state, such that rotation of the crank 30 about the axis 58 is imparted to the gear 110 by virtue of engaging contact between the tooth 128 and the tooth 110*a* on the gear 110.

Figure 13:
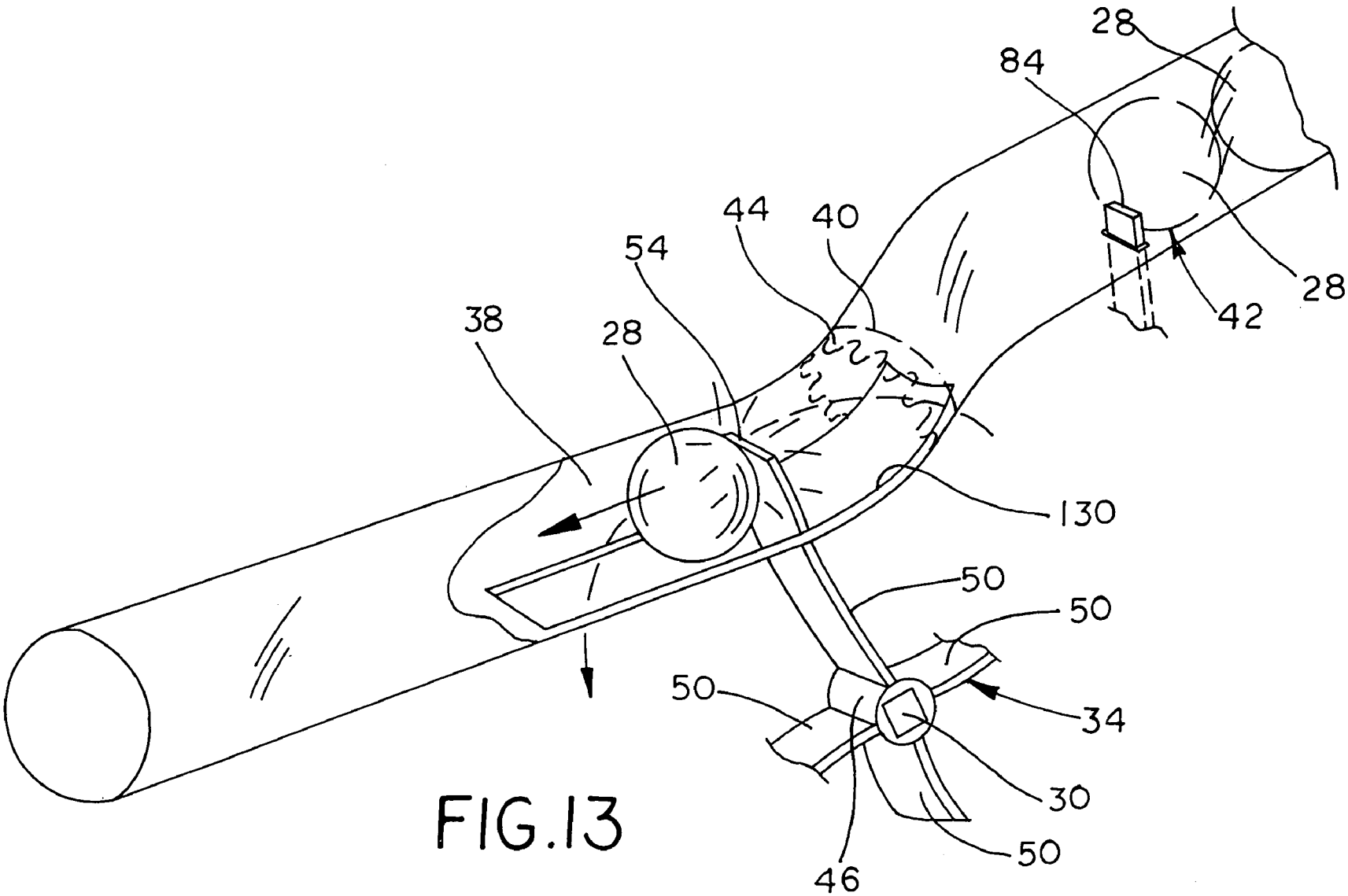
FIG. 13 is an enlarged fragmentary view in perspective illustrating a slot formed adjacent to the launch station and sized to permit the paddle to engage the ball.

Referring now to FIG. 13, the generally tubular passage 38 is shown in partial cutaway. A slot 130 is formed in the passage 38 generally adjacent to the launch station 40. The slot 130 is sized such that each paddle 50 traveling along the path 56 can extend into the generally tubular passage 38 so as to come into contact with the projectile 28 held in the launch station 40 by the constriction 44. It will be appreciated that the slot 130 is sized such that the projectile 28 will not fall through the slot 130.

In operation, the toy gun 20 is prepared for use by inserting a number all of projectiles 28 into the feed tube 36 as can be seen in, for example, FIG. 2. With the toy gun 20 configured as shown in FIG. 2, it will be appreciated that the coupling mechanism 62 is in the decoupled state, with the components of the coupling mechanism 62 positioned as shown in FIGS. 2, 7 and 10. Accordingly, rotation of the crank 30 about the axis 58 using a handle 32 will not impart rotation to the paddlewheel 34. This is because, with reference to FIG. 10, the toothed washer 126 is spaced away from the gear 110 by virtue all of the spring. Consequently, the tooth 128 does not contact the tooth on the gear 110.

When it is desired to prepare the toy gun 20 for use, the feed tube 36 is mounted to the housing 22 adjacent to the inlet 24 as shown in FIGS. 3–6 and 8. As discussed above, and certain of the feed tube 36 as shown causes the pivot arm 64 to pivot about the axis 64*a*, which pulls the link arm 71 toward the right when viewing the Figures. This movement of the link arm 71 causes the pivot lever 66 to pivot about the axis 66*a* from the initial position shown in FIG. 2 toward the position illustrated in FIGS. 3–6 and 8. This movement of the link arm 66 drives the cam plate 68 against the toothed washer 126, such that angled camming surfaces 122 shifts the tooth 128 of the toothed washer 126 into meshing engagement with the corresponding tooth on the gear 110, such as is shown in FIG. 11. When the toy gun 20 is then the coupled condition all of FIGS. 3–6, 8 and 11, rotation of the crank 30 results in rotation of the paddlewheel 34 in a generally counterclockwise direction when viewing FIGS. 3–6.

As shown in FIG. 3, initially the first projectile 28 is maintained at the feed station 42 by the first stop 84. Continued rotation of the paddlewheel 34 brings the end of 54 of the paddle 50 into contact with the first arm 80 of the pivot lever 78, which causes the pivot lever 78 to shift from the position shown in FIG. 3 to the position shown in FIG. 4. This action of causes the first stop 84 to be lowered out of the passage 38, thus permitting the first projectile 28 to pass from the feed station 42 to the launch station 40, where the projectile 28 is caught by the constriction 44, as is shown in FIG. 4. Further, the pivoting action of the pivot lever 78 causes downward movement all and the plate 88, which, by virtue all of the interconnection between the plate 88 and the pivot lever 98 of the second stop 86, causes the second stop 86 to enter the passage 38 and stop the next adjacent projectile 28 from entering the feed station 42. It will be noted when viewing FIG. 4 that the end 54 of the paddle 50 has now encountered the post 74 and has begun to deflect to an energy storing deflected position as the axle 46 and the balance of the paddlewheel 34 continue to rotate along the path 56.

Referring now to FIG. 5, eventually the end 54 of the paddle 50 deflects far enough relative to the still moving paddlewheel 34 that the end 54 slides off of the post 74 and immediately snaps back to its undeflected position. This snapping action releases the energy stored in the bend paddle 50, enabling the paddle 52 contact the projectile 28 disposed in the launch station 40 with sufficient force to eject the projectile from the outlet the 26 of the toy gun 20. At the same time, the pivot lever 78 pivots in a generally counterclockwise direction back toward its original position, which again raises the first stop 84 into the passage 38 and lowers the second stop 86 out of the passage 38, thus retaining the next adjacent projectile 28 in the feed station 42. The process may again be repeated as is shown in FIG. 6, as the next adjacent paddle 50 repeats the process.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A toy gun for launching a foam projectile, the toy gun comprising:

a housing having an outlet and an inlet, both the outlet and the inlet sized to permit passage of the projectile;

a launch station disposed in the housing, the launch station arranged to receive the projectile from the inlet;

a crank mounted to the housing;

a resilient actuating paddle disposed within the housing and mounted to an axle, the axle rotatable in response to rotation of the crank, the paddle shiftable between an undeflected position and an energy storing deflected position, the paddle moveable along a path in response to rotation of the axle and sized to extend into the launch station; and a post disposed in the path, the post positioned to shift the paddle to the deflected position in response to rotation of the axle, the paddle arranged to disengage the post in response to continued rotation of the axle thereby releasing stored energy as the paddle returns to the undeflected position and travels through the launch station.

2. The toy gun of claim 1, including a feed tube sized to hold a plurality of the projectiles, the feed tube removably attached to the housing and arranged to communicate projectiles to the inlet.

3. The toy gun of claim 1, wherein the axle includes a plurality of resilient actuating paddles.

4. The toy gun of claim 1, including a stop disposed adjacent the inlet, the stop shiftable between a first position in which the stop prevents a projectile from entering the launch station and a second position in which the stop permits a projectile to enter the launch station.

5. The toy gun of claim 4, wherein the stop is shiftable between the first position and the second position in response to rotation of the axle.

6. The toy gun of claim 1, wherein the projectile comprises a ball, and including a first stop, a second stop, and a feed station disposed adjacent the inlet, the first stop and the second stop cooperating to permit only a single ball at a time to enter the feed station and the launch station, the first and second stops responsive to movement of the paddle.

7. The toy gun of claim 1, wherein the housing includes a constriction between the launch station and the outlet, the constriction sized to maintain the projectile in the launch station, the constriction further sized to permit passage of the projectile from the launch station to the outlet in response to the application of a force to the projectile.

8. The toy gun of claim 1, wherein the crank is operatively coupled to the paddle wheel by a gear train.

9. The toy gun of claim 8, including a pivot lever disposed adjacent the inlet and arranged to shift in response to mounting a feed tube to the housing adjacent to the inlet, and including a cam plate disposed in the gear train and shiftable between a first state in which the crank and the paddle wheel are operatively decoupled and a second state in which the crank and the paddle wheel are operatively coupled, the cam plate responsive to movement of the pivot lever.

10. The toy gun of claim 9, wherein the pivot lever is operatively connected to the cam plate by a link arm.

11. The toy gun of claim 1, including a feed control mechanism disposed adjacent the inlet.

12. The toy gun of claim 11, wherein the feed control mechanism includes a first stop and a second stop.

13. The toy gun of claim 12, wherein the first and second stops are arranged to respond to respond to movement of the paddle wheel.

14. The toy gun of claim 1, wherein the projectile comprises a ball, and including a feed tube mountable to the housing and arranged to hold a plurality of the balls, at least one of the housing and the inlet arranged to define a feed station, and including a first stop disposed adjacent the feed station and arranged to shift between a first position in which a ball is retained at the feed station and a second position in which a ball may pass from the feed station toward the launch station.

15. The toy gun of claim 14, including a second stop disposed adjacent the feed station and arranged to shift between a first position in which a ball is prevented from entering the feed station and a second position in which a ball may pass into the feed station.

16. The toy gun of claim 15, wherein the first stop and the second stop are responsive to movement of the paddle wheel.

17. A toy gun for launching a foam projectile, the toy gun comprising:

a housing having an outlet and an inlet, both the outlet and the inlet sized to permit passage of the projectile;

a launch station disposed in the housing, the launch station arranged to receive the projectile from the inlet;

a crank mounted to the housing;

a paddle wheel disposed within the housing and having a plurality of resilient actuating paddles, the paddle wheel mounted to a rotatable axle, the axle operatively coupled to the crank;

each paddle shiftable between an undeflected position and an energy storing deflected position, each paddle moveable along a path in response to rotation of the axle and sized to extend into the launch station; and a post disposed in the path, the post positioned to shift each paddle in succession to the deflected position in response to rotation of the axle, each paddle arranged to disengage the post in response to continued rotation of the axle thereby releasing stored energy as the paddle returns to the undeflected position and travels through the launch station.

18. The toy gun of claim 17, including a feed tube sized to hold a plurality of the projectiles, the feed tube removably attached to the housing and arranged to communicate projectiles to the inlet, at least one of the housing and the inlet arranged to define a feed station, and including a first stop disposed adjacent the feed station and arranged to shift between a first position in which a projectile is retained at the feed station and a second position in which a projectile may pass from the feed station toward the launch station.

19. The toy gun of claim 18, including a second stop disposed adjacent the feed station and arranged to shift between a first position in which a projectile is prevented from entering the feed station and a second position in which the projectile may pass the second stop and enter the feed station.

20. The toy gun of claim 19, including a pivot lever disposed adjacent the paddle wheel and movable in response to the passage of each paddle, the pivot lever cooperating with the first stop and the second stop to maintain the first stop in the first position when the second stop is in the second position, and further to maintain the first stop in the second position when the second stop is in the first position.

21. The toy gun of claim 17, wherein the crank is operatively coupled to the paddle wheel by a gear train.

22. The toy gun of claim 21, including a pivot lever disposed adjacent the inlet and selectively shiftable between a first position and a second position, and wherein the gear train includes a cam plate and shiftable between a first position in which the crank and the paddle wheel are operatively decoupled and a second state in which the crank and the paddle wheel are operatively coupled, the cam plate responsive to movement of the pivot lever.

23. A toy gun for launching a foam ball, the toy gun comprising:

a housing having an outlet and an inlet, both the outlet and the inlet sized to permit passage of the ball;

a launch station disposed in the housing, the launch station arranged to receive the ball from the inlet;

a crank mounted to the housing;

a paddle wheel disposed within the housing and having a plurality of resilient actuating paddles, the paddle wheel mounted to a rotatable axle;

a gear train operatively coupling the crank to the axle, the gear train including a clutch, the clutch shiftable between a first position in which the axle is responsive to movement of the crank and a second position in which the axle is not responsive to movement of the crank;

each paddle shiftable between an undeflected position and an energy storing deflected position, each paddle moveable along a path in response to rotation of the axle and sized to extend into the launch station; and a catch disposed in the path, the catch positioned for abutting contact with a selected one of the paddles as the axle is rotated, the catch arranged to shift the selected paddle to the deflected position in response to further rotation of the axle, the catch arranged to release the selected paddle in response to still further rotation of the axle, the paddle upon release arranged to release stored energy as the selected paddle returns to the undeflected position and travels through the launch station.

24. A toy gun for launching a foam projectile, the toy gun comprising:

a housing having an outlet, an inlet, and a passage extending between the outlet and the inlet sized to permit passage of the projectile;

a launch station disposed in the housing, the launch station arranged to receive the projectile from the inlet;

a rotatable wheel disposed within the housing and having at least one resilient actuating paddle, the paddle shiftable between an undeflected position and an energy storing deflected position, the paddle moveable along a path in response to rotation of the wheel and sized to extend into the launch station; and a post disposed in the path, the post positioned to shift the paddle to the deflected position in response to rotation of the wheel, the paddle arranged to disengage the post in response to continued rotation of the wheel thereby releasing stored energy as the paddle returns to the undeflected position and travels through the launch station.

* * * * *

UNITED STATES PATENT AND TRADEMARK OFFICE

CERTIFICATE OF CORRECTION

PATENT NO. : 7,163,009 B2
APPLICATION NO. : 10/664536
DATED : January 16, 2007
INVENTOR(S) : Robert L. Brown et al.

It is certified that error appears in the above-identified patent and that said Letters Patent is hereby corrected as shown below:

On the Title Page:

Item (57), line 3, "A launch station disposed in the housing and is arranged" should be -- A launch station is disposed in the housing and is arranged --.

At Column 10, line 12, "to respond to respond" should be -- to respond --.

Signed and Sealed this

Twentieth Day of April, 2010

David J. Kappos

David J. Kappos
*Director of the United States Patent and Trademark Office*